United States Patent [19]

Stern et al.

[11] Patent Number: 4,879,562

[45] Date of Patent: Nov. 7, 1989

[54] SLOTTED MICROSTRIP ANTENNA WITH FERRITE COATING

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 295,613

[22] Filed: Jan. 9, 1989

[51] Int. Cl.[4] ..... H01Q 1/38; H01Q 3/44

[52] U.S. Cl. ..... 343/700 MS; 343/770; 343/787; 343/873

[58] Field of Search ..... 343/700 MS, 705, 708, 343/767, 768, 770, 771, 185, 787, 873, 746, 851, 872

[56] References Cited

U.S. PATENT DOCUMENTS 4,589,422 5/1986 James et al. ..... 343/787
4,600,018 7/1986 James et al. ..... 343/787

FOREIGN PATENT DOCUMENTS 0015303 1/1983 Japan ..... 343/768

*Primary Examiner*—Rolf Hille
*Assistant Examiner*—Doris J. Johnson
*Attorney, Agent, or Firm*—Michael J. Zelenka

[57] ABSTRACT

A microstrip antenna is improved by applying a thin coating of ferrite material to the surface of the metal ground plane of the antenna by flame spraying or arc plasma spraying. The applied ferrite coating is not exposed to a high temperature anneal cycle.

9 Claims, 1 Drawing Sheet

SIDE VIEW OF CIRCUIT SHOWING VARIOUS LAYERS

SIDE VIEW OF CIRCUIT
SHOWING VARIOUS LAYERS

SLOTTED MICROSTRIP ANTENNA WITH FERRITE COATING

The invention described herein may be manufactured, used, and licensed by or for the Government for governmental purposes, without the payment to us of any royalty thereon.

This invention relates in general to a microstrip antenna and in particular to an improved slotted microstrip antenna that minimizes or eliminates the reflective nature of a slotted microstrip antenna thereby making it difficult for hostile radar to encounter the antenna as a target.

BACKGROUND OF THE INVENTION

Slotted microstrip antennas are often used in aircraft and homing missiles. The antenna includes a bottom microstrip circuit including an array of microstrip lines of an electrically conductive metal, a dielectric layer in contact with and overlying said microstrip circuit, and metal ground plane in contact with and overlying the dielectric layer wherein the ground plane includes a metallic surface with rows of radiating slots etched through the metallic surface such that each row of slots overlies a particular microstrip line in said bottom microstrip circuit. These antennas offer high radiation efficiency and good side lobe control among other features. A difficulty with this type antenna however, is that the radiating slot elements are configured into the surface of the groundplane; the groundplane being a rather large metallic surface with the slots etched through the surface of the groundplane. This type of antenna presents a large, reflective metallic surface that can be easily located and targeted by hostile radar transceivers.

SUMMARY OF THE INVENTION

The general object of this invention is to provide an improved slotted microstrip antenna. A more particular object of the invention is to provide such an antenna that will exhibit a minimal radar target cross-section to hostile radar.

It has now been found that the aforementioned objects can be attained by applying a thin arc-plasma-sprayed, or flame sprayed coating of a ferrite material such as nickel zinc ferrite on the surface of the metal ground plane. The ferrite is not exposed to a high temperature anneal cycle after being flame sprayed thereby presenting a very high RF loss layer, absorbing nearly all RF radar signals impinging on it from hostile radars. Thus, any hostile radar will not receive a return of any signal it sent out and the ferrite coated antenna will be more or less invisible to the hostile radar.

The ferrite layer will be the last step in the fabrication of the antenna so that existing slotted microstrip antennas can employ this process. When applying the ferrite layer, the radiating slots will be masked by means of metal tape, silicone grease, etc. so that the slots will not be sprayed over. The masking will then be removed after the spray process.

One may also arc plasma spray nickel zinc ferrite material on to the ends of the microstrip lines to be terminated similarly as is accomplished in spraying this ferrite on the ground plane surface; both processes accomplishing the task of absorbing RF energy. The use of arc plasma spray in depositing the ferrite as load material is time-saving and economical in this case since the arc plasma spray process is already being used to coat the ground plane of the antenna and thus immediately lends itself to applying the load material to the ends of the microstrip lines without incurring any substantial effort. The circuit is merely flipped over and masked off so that the ferrite material can be sprayed onto the microstrip terminations.

DESCRIPTION OF THE DRAWING

Referring to FIG. 1, FIG. 2, and FIG. 3, the microstrip circuit, 10 includes an input port, 12 leading into a series of power dividers, 14 which in turn lead into microstrip lines 16 affixed onto a dielectric layer 24.

Figure 1:
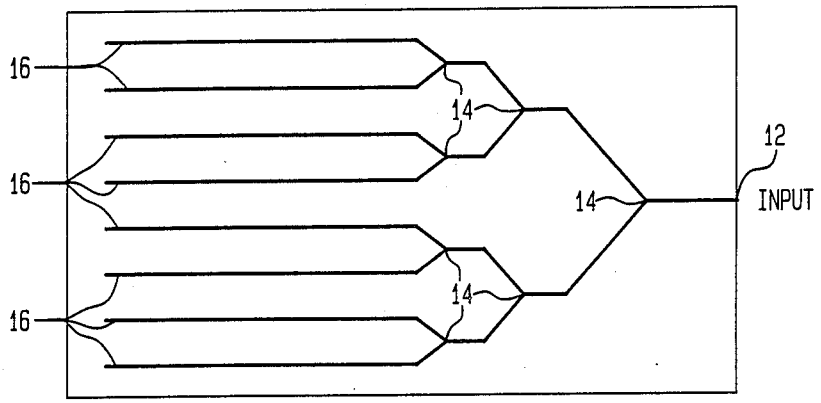
FIG. 1 (PRIOR ART)
FIG. 1 is a plan view of a microstrip circuit.
Figure 2:
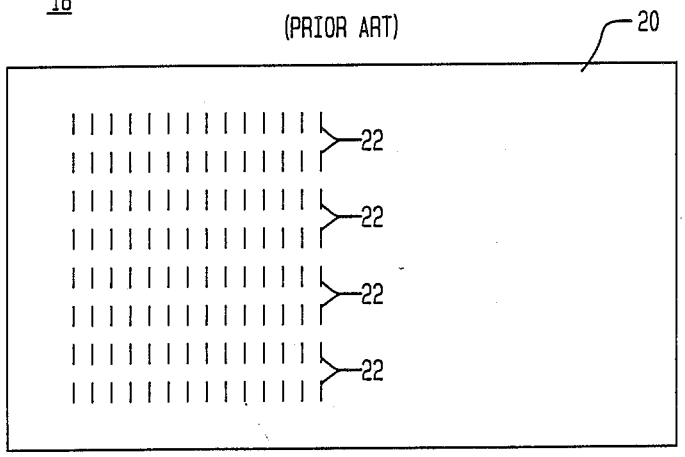
FIG. 2 (PRIOR ART)
FIG. 2 is a plan view of the ground plane surface with radiating slots.
Figure 3:
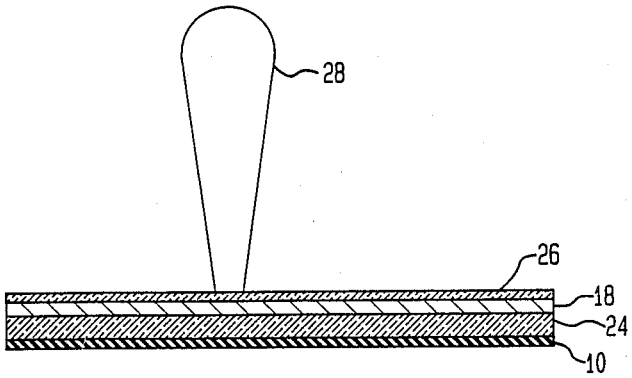
FIG. 3 is a cross-sectional view of a slotted microstrip antenna with characteristics of the resulting radiating beam.

The ground plane, 18 affixed to the top surfaces of the dielectric layer, 24 includes a metallic surface, 20 with rows of radiating slots, 22 etched through the metallic surface, 20.

A flame spray coat of ferrite 26 is included on the surface of the ground plane 18. A pencil beam, 28 that is formed by the arrangement of radiating slots 22 is shown emanating from the ground plane 18 of the antenna.

In operating the antenna as a transmitter as is well known in the art, an RF signal is applied to input port, 12. This signal travels through the microstrip circuit, 10 and is delivered to microstrip lines 16 by means of power dividers, 14. As the RF energy travels down microstrip lines 16 RF energy is radiated through the metallic ground plane, 18 by means of slots, 22. The combined energy radiating from slots 22 forms the pencil beam 28. This antenna will likewise operate to receive return signals from targets. The layer of ferrite coat 26 does not degrade the operation of the antenna.

However, if a hostile radar signal illuminates the antenna the ferrite coat 26 acts to absorb the hostile radar signal, thereby eliminating a return signal or reflection to the hostile source. Hence, the improved antenna of this invention is invisible to the hostile radar.

We wish to to be understood that we do not desire to be limited to the exact details of construction shown and described for obvious modifications will occur to a person skilled in the art.

What is claimed is:

1. In a microstrip antenna including a bottom microstrip circuit including an array of microstrip lines of a conductive metal, a dielectric layer in contact with and overlying said microstrip circuit, and a metal ground plane in contact with and overlying said dielectric layer wherein said ground plane includes a metallic surface with rows of radiating slots etched through the metallic surface such that each row of slots overlies a particular microstrip line in said bottom microstrip circuit, the improvement of applying a thin coating of ferrite material to the surface of the metal ground plane not in contact with the dielectric layer.

2. A microstrip antenna according to claim 1 whrein the ferrite coating is applied by arc plasma spraying.

3. A microstrip antenna according to claim 1 wherein the ferrite coating is applied by flame spraying.

4. A microstrip antenna according to claim 2 wherein the radiating slots are masked prior to applying the ferrite coating.

5. A microstrip antenna according to claim 3 wherein the radiating slots are masked prior to applying the ferrite coating.

6. A microstrip antenna according to claim 4 wherein the applied ferrite coating is not exposed to a high temperature anneal cycle.

7. A microstrip antenna according to claim 5 wherein the applied ferrite coating is not exposed to a high temperature anneal cycle.

8. A microstrip antenna according to claim 6 wherein terminating ends of the bottom microstrip circuit are oversprayed with ferrite material.

9. A microstrip antenna according to claim 7 wherein terminating ends of the bottom microstrip circuit are oversprayed with ferrite material.

* * * * *